US005440792A

United States Patent [19]

Ida

[11] Patent Number: 5,440,792

[45] Date of Patent: Aug. 15, 1995

[54] BUCKLE HAVING RESILIENT LOCKING ARM WITH COACTING RETAINING LUG

[75] Inventor: Kazuo Ida, Toyama, Japan

[73] Assignee: Yoshida Kogyo K.K., Tokyo, Japan

[21] Appl. No.: 237,833

[22] Filed: May 4, 1994

[30] Foreign Application Priority Data

May 7, 1993 [JP] Japan ..... 5-029259 U
Jul. 22, 1993 [JP] Japan ..... 5-044696 U
Jul. 30, 1993 [JP] Japan ..... 5-045944 U

[51] Int. Cl.[6] ..... A44B 11/00

[52] U.S. Cl. ..... 24/615; 24/616; 24/625

[58] Field of Search ..... 24/614, 615, 616, 625, 24/573.1

[56] References Cited

U.S. PATENT DOCUMENTS 1,435,829 11/1922 Fischer ..... 24/616
3,092,885 6/1963 Guanche ..... 24/616
4,282,634 8/1981 Krauss ..... 24/616

FOREIGN PATENT DOCUMENTS 2346586 10/1977 France .
9102723 7/1991 Germany .
54-14317 6/1979 Japan .
61-160618 7/1986 Japan .
0144427 6/1920 United Kingdom ..... 24/616
2159569 12/1985 United Kingdom .
2263136 7/1993 United Kingdom .

*Primary Examiner*—Victor N. Sakran
*Attorney, Agent, or Firm*—Hill, Steadman & Simpson

[57] ABSTRACT

A buckle for fastening loose ends of a strap or the like comprises a male or plug member and a female or socket member releasably engageable therewith. The plug member includes an elastically deformable locking arm and a retaining lug underlying and supporting the arm when the latter undergoes elastic deformation upon engagement with an engaging surface formed in the socket member. The locking arm has an elongated arcuate cavity for snapping engagement with a complementarily shaped engaging surface in the socket member to ensure stable coupling of the two members.

8 Claims, 7 Drawing Sheets

BUCKLE HAVING RESILIENT LOCKING ARM WITH COACTING RETAINING LUG

BACKGROUND OF THE INVENTION

1. Field of the Invention

This invention relates to a buckle for releasably connecting straps, belts or the like on bags or like garment articles.

2. Prior Art

Numerous forms of buckles are known.

An exemplary buckle device disclosed in Japanese Utility Model Publication No. 54-14317 comprises a male member and a female member releasably engageable therewith, the male member having a resilient locking arm provided at its forward end with a locking lug and a rigid positioning arm underlying the locking arm, and the female member having a tunnel-like receptacle dimensioned to receive the two arms. When the male member is inserted into the female member with the locking lug of the locking arm hooked around the edge of an opening in the receptacle, the positioning arm lies flat against a base plate of the female member and serves to retain the locking arm in locked position relative to the female member. A similar buckle device is disclosed in Japanese Patent Publication No. 61-160618, in which a locking arm and a positioning arm extend in parallel relation from a male member for resilient engagement with a female member, the positioning arm being exposed to view through an opening in the locking arm when separated from the female member but concealed under a bridge wall of the female member when coupled with the male member. The locking member has a locking lug formed at its rearward end for abutting engagement with an end wall edge of the bridge. In either of the prior art buckle devices, the locking arm of the male member flexed downwardly or sags upon entry into the female member to an extent determined by the height of the locking lug that comes into hooked engagement with a mating part of the female member. If inadvertently a force was applied in a direction in which the locking arm sags, it would tend to break or otherwise lose its spring-back action. This is more likely as the locking arm is cantilevered. An attempt to increase mechanical strength of the material for the locking arm would conversely reduce its elastic modulus in flexture. This could be compensated for by reducing the height of the locking lug but would result in unreliable operation of the buckle.

SUMMARY OF THE INVENTION

With the foregoing difficulties of the prior art in view, the present invention seeks to provide improvements in a buckle which incorporates structural features such that its male and female members can be coupled and uncoupled with utmost ease and reliability.

More specifically, the invention seeks to provide a buckle which comprises means for controlling the extent to which a locking arm undergoes elastic deformation when the male and female members are coupled or uncoupled and further retaining the locking arm stably in position relative to the female member.

According to the invention, there is provided a buckle for fastening a strap or the like which comprises a plug member and a socket member releasably engageable therewith, the socket member having an upper shield and a lower shield disposed in spaced parallel relation to define therebetween a guide channel, the upper shield having a bevelled engaging surface, and the plug member having a support base, a locking arm receivable in the guide channel including a relatively thin planar portion and a hook portion releasably engageable with the engaging surface and a retaining lug underlying the locking arm and including a projecting abutment normally spaced apart from but abuttingly engageable with the locking arm when the latter felexes downwardly upon entry into the guide channel.

The invention will be described in detail with reference to the drawings in which like reference numerals refer to like or corresponding parts throughout the several views.

DETAILED DESCRIPTION OF THE INVENTION

Figure 1:
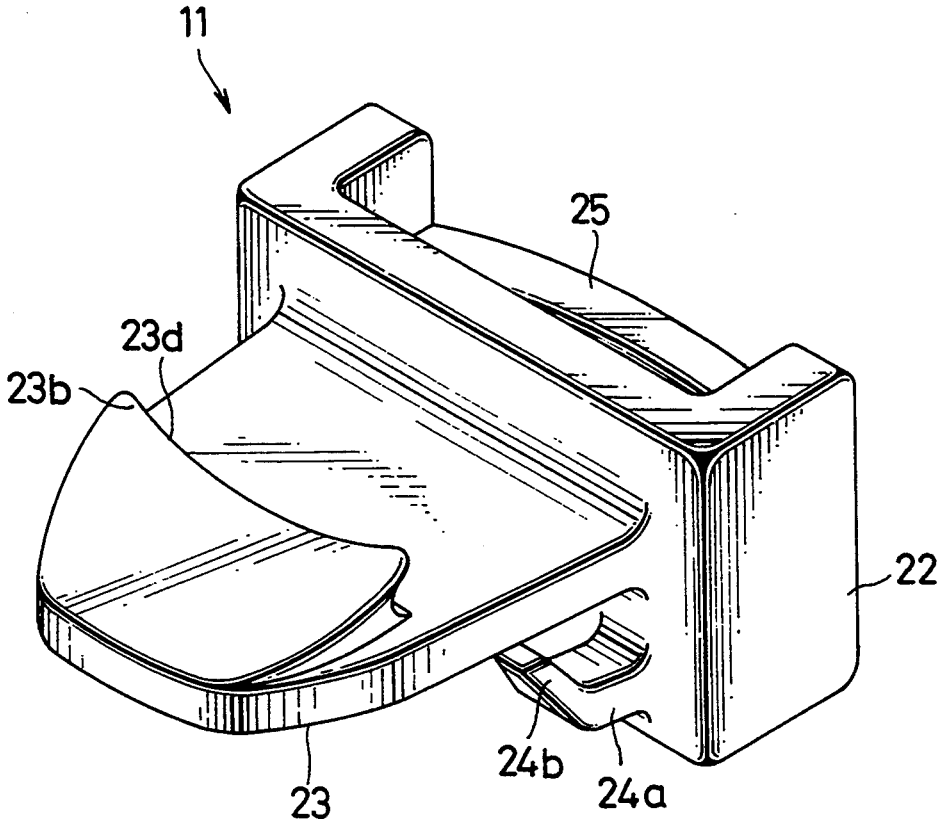
FIG. 1 is a perspective view on enlarged scale of a plug member constituting a male part of a buckle embodying the invention.
Figure 2:
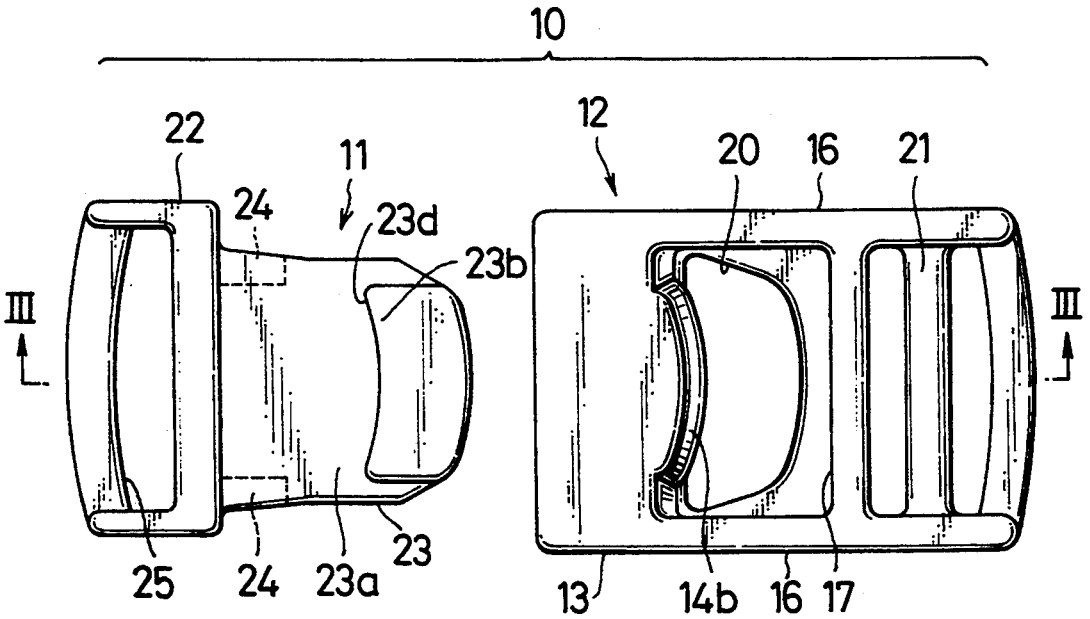
FIG. 2 is a plan view of a plug member and a socket member shown separated.

Referring now to the drawings and firstly FIGS. 1–4 which represent a preferred embodiment of the invention, there is shown a buckle 10 embodying the invention which comprises a male or plug member 11 and a female or socket member 12, both members being moulded suitably from a resilient plastic material.

The female or socket member 12 has a generally rectangular box-like body 13 comprised of an upper shield 14 and a lower shield 15, and a pair of opposed side flanges 16, 16 interconnecting the upper and lower shields 14 and 15 and a vertical end wall 17 closing the rear end of the socket member 12. As better shown in FIG. 3, the shields 14 15, the flanges 16, 16 and the end wall 17 jointly define therebetween a guide channel 18 for receiving the plug member 11 as will be later described. The front end of the socket member 12 is open to provide an entrance 19 in communication with the guide channel 18 for the insertion therethrough of the plug member 11. An opening or window 20 is formed, extending through the upper and lower shield 14 and 15 in communication with the guide channel 18. The transverse inner peripheral edge 14*a* of the upper shield 14 is canted off, as better shown in FIG. 3, to provide a bevelled arcuate engaging surface 14*b*. The upper shield 14 and the lower shield 15 have their respective inner surfaces 14*c* and 15*a* disposed in parallel relation and spaced apart by a distance such that the plug member 11 is snapped into and retained firmly in place within the guide channel 18 of the socket member 12 as will be later described.

The socket member 12 includes a strap retainer 21 remote from the entrance 19 for retaining one end of a strap or belt (not shown) in a manner well known in the art.

The male or plug member 11, as better depicted in FIG. 1, has a support base 22, a tongue-like locking arm 23 extending longitudinally integrally from one end of the base 22 in a direction to engage with the socket member 12, and a pair of retaining lugs 24, 24 extending from opposite sides of the base 22 in underlying relation to the locking arm 23. The plug member 11 includes a strap retainer 25 at the opposite end of the base 22 for retaining the other end of a strap or belt in a manner well known in the art.

The locking arm 23 of the plug member 11 includes a relatively thin planar portion 23*a* and a relatively thick hook portion 23*b* formed integral therewith and tapering as at 23*c* in the direction of insertion of the plug member 11 into the socket member 12. The hook portion 23*b* is recessed to provide a transversely elongated arcuate cavity 23*d* opening toward the base 22 and adapted to receive the complementary arcuate engaging surface 14*b* of the socket member 12.

Figure 3:
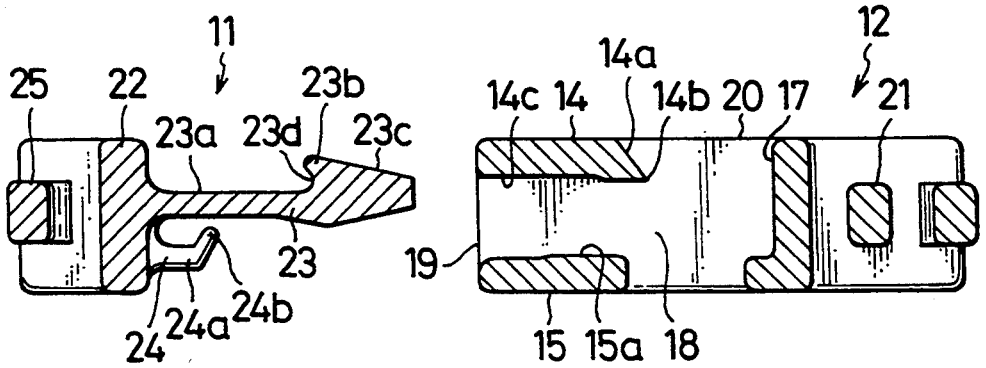
FIG. 3 is a longitudinal cross-sectional view taken on the line III—III, of FIG. 2.

Each of the retaining lugs 24, 24 includes a stem portion 24*a* and an upwardly projecting abutment 24*b* normally spaced apart from the lower surface of the planar portion 23*a* of the locking arm 23 as shown in FIG. 3.

Figure 4:
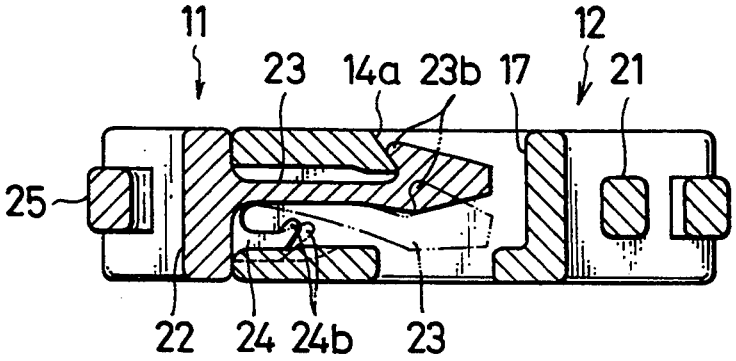
FIG. 4 is a view similar to FIG. 3 but showing the buckle in coupled condition.

With this construction of the buckle 10 shown in FIGS. 1–4, the plug member 11 and the socket member 12 are coupled together by inserting the locking arm 23 through the entrance 19 into the guide channel 18. The locking arm 23 flexes downwardly about an axis in the planar portion 23*a* as the hook portion 23*b* engages slidingly with the inner surface of the upper shield 14 of the socket member 12, and advances to a point where the hook portion 23*b* snaps into locked engagement with the upper shield 14 with the arcuate cavity 23*d* anchored over and around the edge of the bevelled engaging surface 14*b* and with the retaining lugs 24, 24 seated on the inner surface of the lower shield 15 to hold the locking arm 23 stably in place as shown in FIG. 4, in which instance the retaining lugs 24, 24 serve with its projecting abutment 24*b* to limit and control the downward flexture of the locking arm 23 within the guide channel 18 to an extent required for the hook portion 23*b* to move past the upper shield 14 until the cavity 23*d* hooks snappingly around the edge of the engaging surface 14*b*, thus preventing excessive fatal, elastic deformation of the locking arm 23.

Separation of the plug member 11 from the socket member 12 is done by depressing the hook portion 23*b* of the locking arm 23 through the window 20 in the socket member 12 to move apart from the engaging surface 14*b* and then pulling the plug member 11 out of the guide channel 18, in which instance also the retaining lugs 24, 24 serve to limit the downward flexing movement of the locking arm 23.

Various modifications may be considered in the foregoing buckle structure to provide additional or improved results and some of such modifications are set out below.

Figure 5:
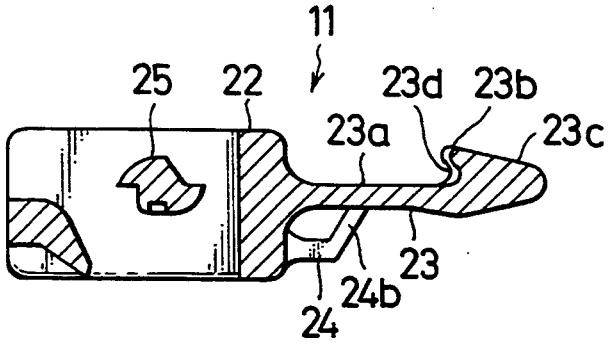
FIG. 5 is a cross-sectional view of a modified form of the plug member.

FIG. 5 shows a second embodiment of the invention in which the retaining lugs 24, 24 are disposed with their respective projecting abutments 24*b*, 24*b* formed integrally with or closely adjacent to the lower surface of the planar portion 23*a* of the locking arm 23. This arrangement is suitable particularly with a buckle of the type which requires increased strength of a plug-to-socket coupling.

Figure 6:
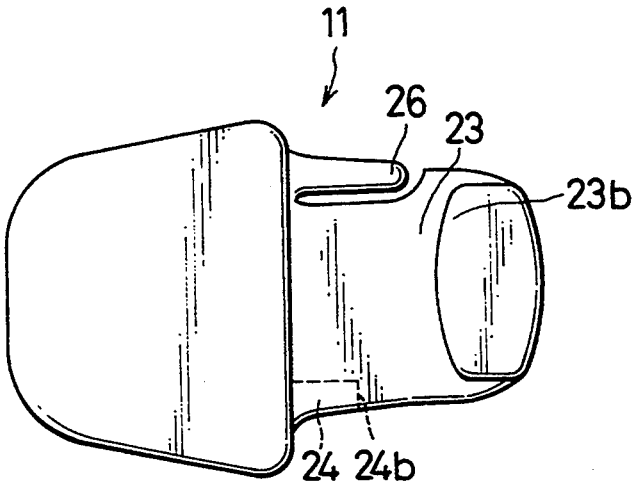
FIG. 6 is a plan view of another modified form of the plug member.
Figure 7:
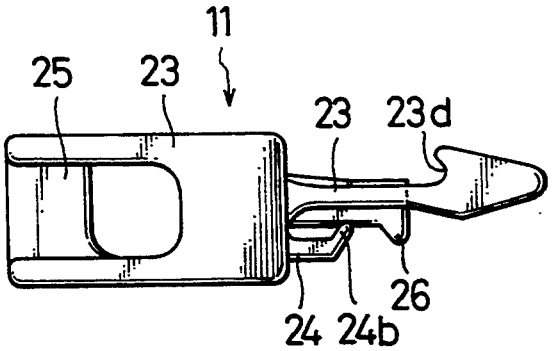
FIG. 7 is a cross-sectional view of the same.

FIGS. 6 and 7 show a third embodiment in which one of the pair of retaining lugs 24, 24 is replaced by an anchoring lug 26 having a downwardly projecting abutment 26*a*, the arrangement being that the plug member 11 can be retained firmly in place relative to the socket member 12.

Figure 8:
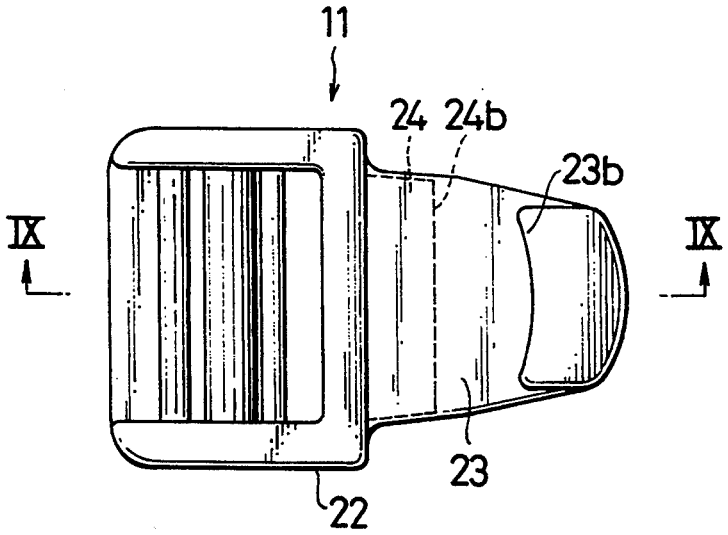
FIG. 8 is a plan view of a further modified form of the plug member.
Figure 9:
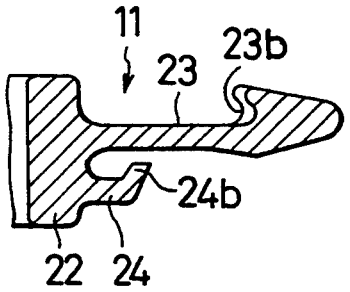
FIG. 9 is a cross-sectional view taken on the line IX—IX of FIG. 8.

FIGS. 8 and 9 show a fourth embodiment in which the retaining lugs 24, 24 are joined together into a one piece structure extending transversely coextensively with the locking arm 23, resulting in reinforced lug construction.

Figure 10:
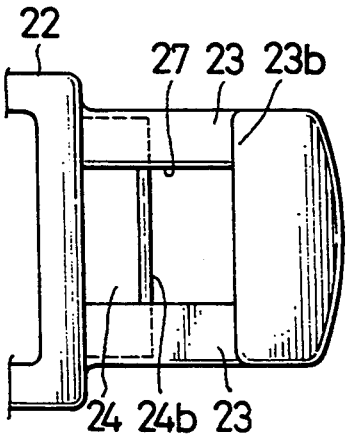
FIG. 10 is a plan view of still another modified form of the plug member.

FIG. 10 shows a fifth embodiment which is similar to the fourth embodiment but differs in that the locking arm 23 is cut out to provide an opening 27 in the planar portion 23*a* with a view to facilitating flexture of the locking arm 23.

Figure 11:
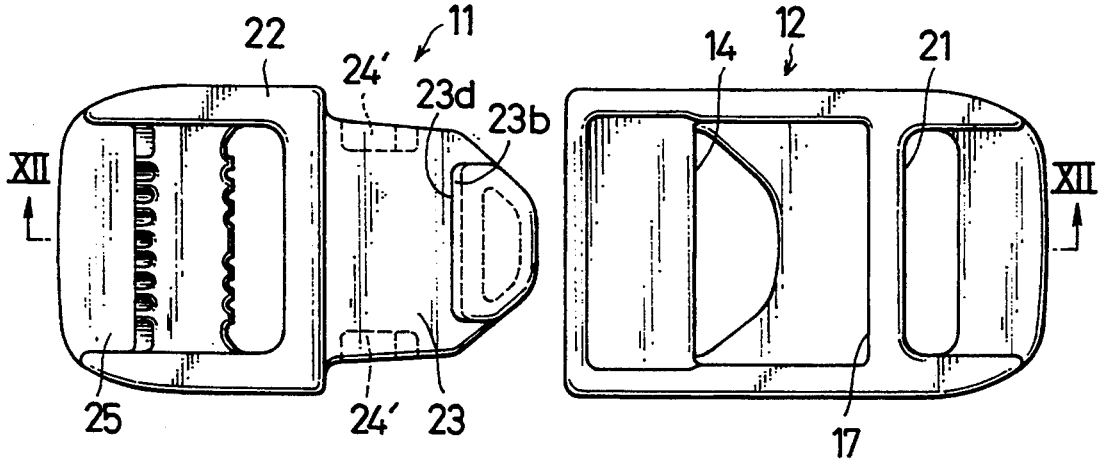
FIG. 11 is a plan view of a further modified form of the plug member shown separated from a mating socket member.
Figure 12:
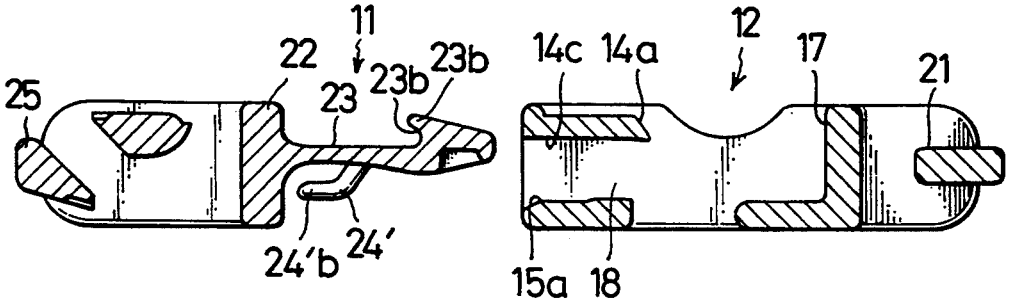
FIG. 12 is a cross-sectional view taken on the line XII—XII of FIG. 11.
Figure 13:
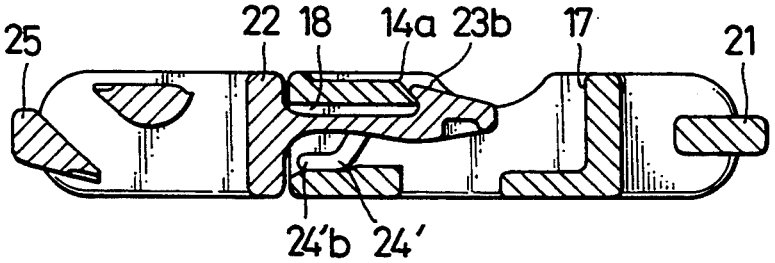
FIG. 13 is a view similar to FIG. 12 but showing the buckle in coupled condition.

FIGS. 11, 12 and 13 show a sixth embodiment in which the retaining lugs 24', 24' each are in the form of an inverted "L" structure cantilevered to the planar portion 23*a* of the locking arm 23, with their respective projections 24'*b*, 24'*b* directed closely toward the base 22 of the plug member 11, the arrangement being that the retaining lugs 24', 24' can resiliently engage with the inner surface of the lower shield 15 to provide for stable coupling posture of the buckle 10.

Figure 14:
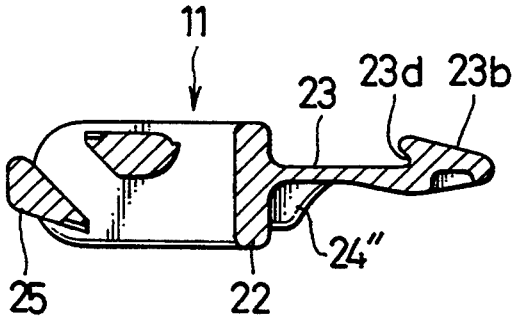
FIG. 14 is a cross-sectional view of another modified form of the plug member.

FIG. 14 shows a seventh embodiment of the invention is which each of the pair of retaining lugs 24'', 24'' is devoid of the projecting abutment 24*b* and formed integrally with the support base 22 of the plug member 11 thereby strengthening the joint between the locking arm 23 and the base 22.

Figure 15:
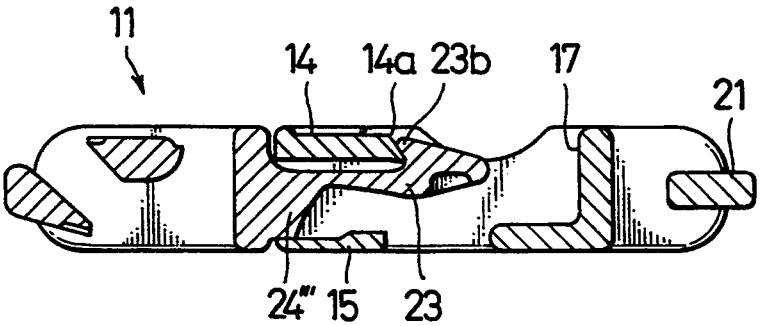
FIG. 15 is a cross-sectional view of a further modified form of the plug member.

FIG. 15 shows an eighth embodiment characterized by the provision of a single retaining lug 24''' formed integrally with both the base 22 and the locking arm 23 and transversely coextensive with the locking arm 23 with a view to further reinforcing the latter.

Figure 16:
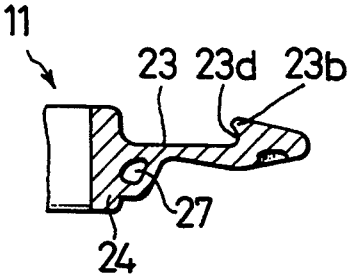
FIG. 16 is a cross-sectional view of still another modified form of the plug member

FIG. 16 shows a nineth embodiment in which the retaining lug 24' of FIG. 14 or the retaining lug 24''' of FIG. 15 is provided with a transversely extending through-opening 27.

Many other variations or modifications may be made in the construction herein above advanced without departing from the scope of the appended claims.

What is claimed is:

1. A buckle for fastening a strap or the like which comprises a plug member and a socket member releasably engageable therewith, said socket member having an upper shield and a lower shield disposed in spaced parallel relation to define therebetween a guide channel, said upper shield having a bevelled engaging surface, and said plug member having a support base, a locking arm receivable in said guide channel including a relatively thin planar portion and a hook portion releasably engageable with said engaging surface and a retaining lug underlying said locking arm and including a projecting abutment normally spaced apart from but abuttingly engageable with said locking arm when the latter flexes downwardly upon entry into said guide channel.

2. A buckle according to claim 1 wherein said locking arm has a hook portion recessed to provide an elongated arcuate cavity for receiving a complementary engaging surface of said upper shield.

3. A buckle according to claim 1 wherein said plug member is provided at opposite sides with a pair of retaining lugs for abutting engagement with said locking arm.

4. A buckle according to claim 1 wherein said plug member is provided with an anchoring lug at a side opposite to said retaining lug.

5. A buckle according to claim 1 wherein said retaining lug has its projecting abutment disposed closely adjacent to or formed integrally with said locking arm.

6. A buckle according to claim 1 wherein said plug member has a retaining lug cantilevered at said planarn portion of said locking arm.

7. A buckle for fastening a strap or the like which comprises a plug member and a socket member releasably engageable therewith, said socket member having an upper shield and a lower shield disposed in spaced parallel relation to define therebetween a guide channel, said upper shield having a bevelled engaging surface, and said plug member having a support base, a locking arm receivable in said guide channel including a relatively thin planar portion extending from said support base, and a hook portion extending from an end of said planar portion toward said support base engageable with said engaging surface, and a retaining lug formed integral with said base and said locking arm and extending therebetween to support said arm when the latter flexes downwardly upon entry into said guide channel.

8. A buckle according to claim 7 wherein said retaining lug is substantially transversely coextensive with said locking arm.

* * * * *